US006269760B1

(12) United States Patent
Moore

(10) Patent No.: US 6,269,760 B1
(45) Date of Patent: Aug. 7, 2001

(54) WIDE NEEDLE SWING OSCILLATING HOOK SYSTEM FOR SEWING MACHINES

(76) Inventor: Robert A. Moore, 1243 Balfour Dr., Arnold, MD (US) 21012

( * ) Notice: Subject to any disclaimer, the term of this patent is extended or adjusted under 35 U.S.C. 154(b) by 0 days.

(21) Appl. No.: 09/684,663

(22) Filed: Oct. 10, 2000

Related U.S. Application Data

(60) Provisional application No. 60/158,136, filed on Oct. 8, 1999.

(51) Int. Cl.[7] ..... D05B 57/12; D05B 57/38

(52) U.S. Cl. ..... 112/220; 112/192

(58) Field of Search ..... 112/220, 182, 112/181, 189, 190, 192, 199; 74/22 R, 25, 29, 30, 52

(56) References Cited

U.S. PATENT DOCUMENTS 1,613,605 * 1/1927 Corrall et al. .
2,464,079 * 3/1949 Gagauf ..... 112/192
3,235,467 * 2/1966 Beyer .
4,924,788 5/1990 Brown .
4,966,043 10/1990 Frey .
6,032,597 * 3/2000 Inagaki ..... 112/192
6,182,589 * 2/2001 Anderegg et al. ..... 112/192 X

* cited by examiner

*Primary Examiner*—Ismael Izaguirre
(74) *Attorney, Agent, or Firm*—Leydig, Voit & Mayer, Ltd.

(57) ABSTRACT

A zigzag sewing machine includes an oscillating hook. The transverse needle swing amplitude of the needle of the sewing machine is increased in amplitude from that of conventional free-arm domestic sewing machines with oscillating hooks, for example, from 5 mm to 9 mm. The increased amplitude is provided by a novel drive mechanism including a rack oscillating transversely between two extreme positions in response to rotation of a driving wheel and a pinion engaging the rack. The pinion is coupled to and drives the oscillating hook. The pinion may have a variable radius, may be coupled to the driving wheel through other racks and pinions, and may be coupled to the driving wheel through a multiple bar linkage. A constant rotation speed of the driving wheel causes the hook to oscillate at a rotational velocity that varies with rotational position of the hook so that swing amplitude of the needle transverse to the linear direction may be increased.

20 Claims, 6 Drawing Sheets

WIDE NEEDLE SWING OSCILLATING HOOK SYSTEM FOR SEWING MACHINES

This disclosure claims the priority of U.S. Patent Application Ser. No. 60/158,136, filed Oct. 8, 1999.

FIELD OF THE INVENTION

This invention pertains to an oscillating hook system for a zigzag sewing machine for sewing seams and designs in a fabric. More particularly, the invention relates to a mechanism providing increased amplitude transverse needle swing in a zigzag sewing machine utilizing an oscillating hook system.

BACKGROUND OF THE INVENTION

Several mechanical systems provide for transverse needle swing in zigzag sewing machines. The transverse needle swing, i.e., from side to side, in the course of sewing a fabric, aids in sewing, particularly in sewing a seam or design in a fabric. The term fabric is used here to refer to any material that may sewn on a sewing machine and is not limited to a woven material including a warp and weft. Non-woven fabrics and sewable goods that are not fabrics at all, for example, plastics and leather, are within the scope of the term "fabric" as used here.

Conventional sewing machines produce zigzag stitching by using either a rotary hook system that provides a relatively wide transverse needle swing, for example, an amplitude of 9 millimeters between the extreme transverse positions of needle swing, or an oscillating hook system. In the oscillating hook system, the transverse swing has been limited, particularly in free-aim consumer sewing machines, to an amplitude of about five millimeters. The invention described below particularly pertains to oscillating hook system sewing machines providing a wider traverse needle swing without loss of the higher stitch quality produced by the oscillating hook mechanism.

FIGS. 1(*a*) and 1(*b*) are schematic front and rear views of a conventional oscillating hook sewing machine drive system in a free-arm sewing machine. The front view of FIG. 1 (*a*) is cut away to show thread, needle, and bobbin relationships and is the view that a person operating the sewing machine would see if the free arm covering were transparent. FIG. 1(*b*) is a rear view of the oscillating hook system showing a driving mechanism for driving the oscillating hook. FIG. 1(*a*) illustrates a "front loading" configuration in which a bobbin is inserted into the sewing machine along a direction perpendicular to the plane of FIG. 1 (*a*). However, other arrangements, to which the invention likewise applies, are known. For example, the bobbin may be loaded from the side, i.e., along a direction parallel to the plane of FIG. 1(*a*). Still other bobbin loading positions may be employed. Although the invention, described below, is not limited to a particular bobbin loading configuration, the illustrated front loading bobbin arrangement is preferred.

In all figures, like elements are given the same reference number. In FIG. 1(*a*), a needle 1 engages a needle thread 2. Thread is used in a general sense here and means any multiple strand or single strand filament that can be used to join two pieces of fabric or to decorate a fabric. The needle thread 2 passes through a hole or eye of the needle 1. The needle 1 is driven by a motor, not shown, in an oscillating motion in a generally linear direction, usually vertical, subject to the transverse swing of the zigzag stitch. The drive from the motor may be indirect, through gears, belts, or the like. The needle, in its linear, up and down motion, passes through a hole 3 in a needle plate 4 that supports a fabric (not shown) being sewn. The needle thread 2 is maneuvered, as described below, by an oscillating hook 5. A second thread, a bobbin thread 6 is supplied from a bobbin 7 that is coaxial with the hook 5.

As shown in FIG. 1(*b*), the oscillating hook 5 includes a shaft with a toothed gear, i.e., a pinion, 20 that is driven by a rack 21 having teeth that engage the teeth of the gear 20. The rack 21 is pivotally connected to a link 22 at a pin 23 that permits rotational movement of the rack 21 relative to the link 22. The opposite end of the link 22 is pivotally pinned by a pin 25 to a driven rotating wheel 24 near the periphery of the wheel. The wheel 24 is rotationally driven by a motor (not shown), directly or through gears, belts, or another transmission mechanism. Preferably, the same motor drives the wheel 24 and the needle 1. Separate motor drives may be used provided they are maintained in synchronization.

In the conventional mechanism shown in FIG. 1(*b*), as the wheel 24 rotates, the link 22 is caused to move transversely, i.e., from left to right, in, essentially, simple harmonic motion. The rack 21 likewise, to the extent its motion is only planar, moves in nearly simple harmonic motion. Because of the presence of the two separate elements, the link 22 and the rack 21 connected at the pin 23, the actual motion of the rack 21 deviates from simple harmonic motion. The deviation is relatively small and of the second order. For purposes of this disclosure, that minor deviation is considered to be insignificant and the term "simple harmonic motion" is used to encompass the repetitive cyclic transverse movement of the rack 21 between extreme left and extreme right positions. As understood from the basic definition of simple harmonic motion, at two points in each cycle, a moving element has a zero velocity. The speed of the element increases from the two zero velocity points, e.g., the most extreme right and left positions of the rack 21 in FIG. 1(*a*), to a maximum velocity at a position intermediate the two extreme positions.

The stitching produced by the rotation of the wheel 24 in driving the hook 5 through the engagement of the gear 20 and the rack 21 is described with respect to FIGS. 2(*a*)–2(*d*). FIGS. 2(*a*)–2(*d*) show four sequential positions of the oscillating hook 5. In FIG. 2(*a*), the oscillating hook 5 is in an extreme position after rotating counterclockwise and is at zero velocity. This extreme position is approximately synchronized with the lowest position of the needle 1. The needle thread 2 extends from a source of thread, e.g., a spool, and other mechanisms (not shown), downward and through the eye of the needle 2. The other mechanisms include a means of adjusting the tension of the thread and a take-up lever, known elements of conventional sewing machines located above the needle plate 4. The thread 2 extends beneath the needle plate 4, through the hole 3, loops, and extends back and out through the hole 3 in the needle plate 4 on the top side of the needle plate 4. A needle thread loop 8 is located beneath the needle plate 4. The bobbin thread 6 extending from the bobbin 7 underneath the needle plate 4 also passes through the hole 3 and extends on the top side of the needle plate 4.

As shown in FIG. 2(*b*), as the needle 1 begins to rise, the hook 5 begins to turn clockwise, a hook finger 9 on the end of the hook 5 passes through and engages the needle thread loop 8 at a position spaced from the needle 1. The hook 5 continues to rotate in a clockwise direction, as shown in FIG. 2(*c*), increasing the size of the needle thread loop 8 as the hook finger 9 pulls on the needle thread 2. The needle thread look 8 is pulled almost completely around the bobbin 7. The needle 1 is in approximately its highest position in FIG. 2(*c*).

At that position, the take-up lever (not shown) above the needle plate 4 is beginning to rise, pulling on the needle thread 6.

The take-up lever continues to rise and, as shown in FIG. 2(*d*), the needle thread 2, formerly wrapped around the bobbin 7, slips off the hook finger 9, surrounding the bobbin thread 6. The needle thread loop 8 is pulled closed, gripping the bobbin thread 6, and brought tight against the bottom surface of the fabric being sewn, so that a locked stitch is formed. The needle 1 finishes its rise and then moves downward to form another needle thread loop 8 for the next stitch. In the meantime, the hook 5 rotates counterclockwise, starting from a zero velocity at the maximum clockwise position, moving to its maximum counterclockwise position, i.e., the position shown in FIG. 2(*a*). In this arrangement, the hook 5 reaches its most counterclockwise position at approximately the same time the needle 1 reaches its lowest position. Thereafter, the stitching cycle as described is repeated. The position and the timing of the motion reversals at the extreme rotational positions of the hook 5 relative to the needle 1, and the timing of the engagement by the hook finger 9 of the needle thread loop 8 are critical to proper stitching by a sewing machine incorporating the oscillating hook mechanism.

The movement of the oscillating hook in the sequence shown in FIGS. 2(*a*)–2(*d*) is illustrative, not limiting. For example, operation in a mirror image configuration is possible and the invention, described below, is not limited to a particular orientation of the hook finger 9.

In the sequence of motions illustrated in FIGS. 2(*a*)–2(*d*), it is apparent that the needle 1 is moving upward at the time the hook finger 9 moves toward the needle 1 to engage the needle thread loop 8. The position along the length of the shank of the needle 1 at which the hook can reliably engage the needle thread loop 8 is limited by the vertical extent of the needle thread loop that is formed behind the needle 1 as the needle rises from its lowest point towards its highest point. Those of skill in the art refer to adjusting the synchronization of the needle, needle thread loop, and the hook finger as setting the hook timing.

To produce design or zigzag stitching on a fabric, a sewing machine may control the needle 1 to penetrate the fabric at a center position aligned with a vertical axis of the needle or at offset positions on either side of the center position. When the needle penetrates the fabric to the left of the center position of the needle, with respect to the description of FIGS. 2(*a*) and 2(*b*), the hook finger 9 engages the needle thread 2 at a time earlier in the stitch cycle and at a position higher relative to the needle shank than when the needle penetrates the sewing material at a center position. Likewise, when the needle penetrates the fabric at a position to the right of the center position of the needle 1, the hook finger 9 engages the needle thread loop 8 at a position that is lower relative to the shank of the needle. The relationship between the positions of the needle 1 and the hook finger 9 at the moment of engagement of the needle thread loop 8 for left of center, center, and right of center stitch positions are illustrated in FIGS. 3(*a*), 3(*b*), and 3(*c*), respectively. For simplicity, the needle thread 2 and the bobbin thread 6 are omitted from these figures. FIG. 3(*a*) demonstrates that the hook finger 9 is at a higher position relative to the shank of the needle 1 in the left of center position than for the other two positions. Likewise, the hook finger 9 is lower relative to the shank of the needle 1 in the rightmost position of the needle in FIG. 3(*c*) as compared to the other two illustrated positions.

FIGS. 3(*a*)–3(*c*) show that as the left-right swing of the needle increases in amplitude, the difference in hooking position relative to the shank of the needle increases. However, the distance along the needle shank for which the needle thread loop 8 is reliably engaged by the hook finger 9 is limited. Thus, the amplitude of the left-right needle swing in an oscillating hook sewing machine is limited to ensure proper sewing results. For example, in conventional consumer sewing machines with a free-arm construction and oscillating hook, the amplitude of the needle swing is limited to approximately 5 millimeters.

If the rotational speed of the oscillating hook were proportionally increased as the transverse needle swing amplitude is increased, the hooking position at which the hook finger reliably engages the needle thread loop 8 relative to the shank of the needle 1 could be maintained within the range depicted in FIGS. 3(*a*)–3(*c*). The rotational velocity of the hook finger 9 can be increased without changing the angular velocity of the hook shaft or changing the timing of the rotation reversals of the hook 5 by increasing the diameter of the hook 5. However, increasing the diameter of the hook would undesirably increase the size of the free arm of a free-arm sewing machine for domestic use.

In a rotary hook mechanism, higher hook speed and, consequently, wider transverse needle swing may be achieved because the rotary hook makes two continuous complete rotations for each stitch cycle rather than the clockwise and counterclockwise oscillation of the oscillating hook for each stitch cycle. The oscillating hook provides greater stitch precision than the rotary hook because the oscillating hook stops and changes direction twice during each stitching cycle. With each change in rotational direction of the oscillating hook, the needle thread passes with no resistance between the hook finger 9 and the hook driving mechanism, minimizing the effects on manual thread tension adjustments relative to changing sewing conditions. By contrast, in the rotary hook system, the needle thread must be pulled past the hook driving mechanism for each stitch. Thus, the needle thread tension requirements change with changing sewing conditions, requiring more frequent manual tension adjustments. Thus, although the rotary hook system can sew faster, thread tension settings are more sensitive to sewing conditions with a rotary hook system than with an oscillating hook system. Since the oscillating hook mechanism provides more consistent stitch quality with less required operator control, it is particularly desirable to provide an improvement in the oscillating hook mechanism that provides for wider amplitude transverse needle swing.

SUMMARY OF THE INVENTION

It is an object of the invention to provide an oscillating hook mechanism for a sewing machine, providing increased transverse needle swing over the needle swings achieved with prior art oscillating hook systems.

It is a further object of the invention to provide an oscillating hook system for a sewing machine providing for transverse needle swings as large as 9 millimeters in a free-arm sewing machine.

According to one aspect of the invention, in a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook includes a rotating driving wheel; a rack coupled to the driving wheel and oscillating transversely between two extreme positions in response to rotation of the driving wheel; and a pinion engaging the rack, the pinion being coupled to and driving the oscillating hook, wherein the pinion has a radius that varies over a first part of a circumference and has an average radius over a second part of the circumference of the pinion that is larger than an average of the radius over the first part of the circumference, and the rack has a width that varies with position to accommodate the radius of the pinion that varies, whereby, in response to a constant rotation speed of the driving wheel, the hook is oscillated at a rotational velocity that varies with rotational position of the hook so that swing amplitude of the needle transverse to the linear direction may be increased.

According to a second aspect of the invention, in a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook includes a rotating driving wheel; a rack coupled to the driving wheel and driven transversely in simple harmonic motion between two extreme positions in response to rotation of the driving wheel; and a pinion engaging the rack, the pinion being coupled to and driving the oscillating hook and having a non-uniform radius, and the rack having a varying width where the rack engages the pinion to accommodate the non-uniform radius of the pinion, whereby, in response to a constant rotation speed of the driving wheel, the hook is oscillated at a velocity that varies with rotational position of the hook so that swing amplitude of the needle transverse to the linear direction may be increased.

According to a third aspect of the invention, in a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook includes a rotating driving wheel having a coaxially mounted stationary first gear and a rotating second gear eccentrically mounted on the rotating driving wheel and engaging the first gear; a rack coupled to the driving wheel and oscillating transversely between two extreme positions in response to rotation of the driving wheel; a link coupling the rack to the driving wheel, pivotally connected at a first end to the second gear and pivotally connected at a second end to the rack for driving the rack in response to rotation of the driving wheel; and a pinion engaging the rack, the pinion being coupled to and driving the oscillating hook, whereby, in response to a constant rotation speed of the driving wheel, the hook is oscillated at a rotational velocity that varies with rotational position of the hook so that swing amplitude of the needle transverse to the linear direction may be increased.

According to a fourth aspect of the invention, in a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook includes a rotating driving wheel having a coaxially mounted stationary first gear and a rotating second gear eccentrically mounted on the rotating driving wheel and engaging the first gear; a first rack coupled to the driving wheel and oscillating transversely between two extreme positions in response to rotation of the driving wheel; a first pinion engaging the first rack and including a coaxial second pinion, the first and second pinions differing in diameter; a second rack engaging the second pinion; and a third pinion engaging the second rack and driving the oscillating hook, whereby, in response to a constant rotation speed of the driving wheel, the hook is oscillated at a velocity that varies with rotational position of the hook so that swing of the needle transverse to the linear direction may be increased.

According to a fifth aspect of the invention, in a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook includes a rotating driving wheel; a rack coupled to the driving wheel and oscillating transversely between two extreme positions in response to rotation of the driving wheel; a slotted lever including a longitudinal slot, the slotted lever being pivotally mounted on a pivot at a first end of the slotted lever remote from the slot; a first link pivotally connected at a first end to the driving wheel and pivotally connected at a second end to the slotted lever; a second link pivotally connected at one end to the rack and including a pin at a second end, the pin being slidably disposed in the longitudinal slot of the slotted lever for sliding relative to the slotted lever in response to rotation of the driving wheel and pivoting of the slotted lever for driving the rack; and a pinion engaging the rack, the pinion being coupled to and driving the oscillating hook, whereby, in response to a constant rotation speed of the driving wheel, the hook is oscillated at a rotational velocity that varies with rotational position of the hook so that swing amplitude of the needle transverse to the linear direction may be increased.

According to a sixth aspect of the invention, in a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook includes a rotating driving wheel; a pivoting lever pivoted at a first end and coupled to the driving wheel; a first rack; a first pinion engaging the first rack and rotationally mounted on a pin on the pivoting lever; a second rack oscillating transversely between two extreme positions in response to rotation of the driving wheel; a link pivotally connected at one end to the first pinion and pivotally connected at a second end to the second rack; and a second pinion engaging the second rack, the second pinion being coupled to and driving the oscillating hook whereby, in response to a constant rotation speed of the driving wheel, the hook is oscillated at a velocity that varies with rotational position of the book so that swing of the needle transverse to the linear direction may be increased.

BRIEF DESCRIPTION OF THE DRAWINGS

FIG. 1(*b*) is a schematic rear view, partially broken away, of the conventional free-arm sewing machine shown in FIG. 1(*a*) and illustrating a mechanism for driving the oscillating hook.

DETAILED DESCRIPTION

As described with respect to FIG. 2(*b*), at the time of the engagement of the hook finger 9 with the needle thread loop 8, the oscillating hook 5 has just started rotating, clockwise in FIG. 2(*b*), from the extreme, fully stopped position of FIG. 2(*a*). Thus, the oscillating hook 5 is moving at a relatively slow speed when the hook finger 9 engages the needle thread loop 8. As already pointed out, if the rotational speed of the oscillating hook 5 is increased, the transverse swing of the needle can be increased in amplitude without loss of reliable engagement of the needle thread loop 8 by the hook finger 9. According to the invention, the speed of the hook 5 and the amplitude of the transverse needle sewing are increased without the necessity of increasing the diameter of the oscillating hook 5.

Figure 4:
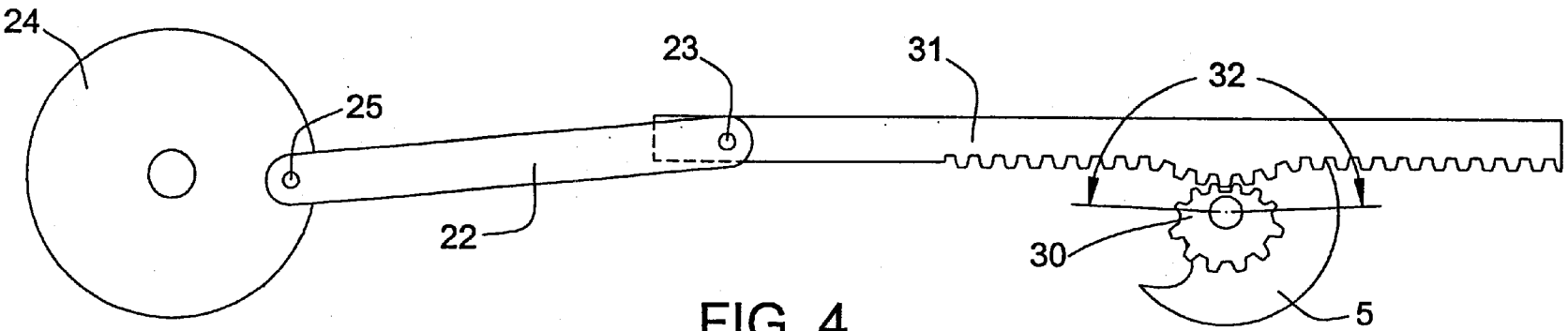
FIG. 4 is a schematic diagram illustrating an embodiment of the invention.

One embodiment of the driving part according to the invention is illustrated schematically in FIG. 4. FIG. 4 is a rear view, partially cut away, similar to FIG. 1(*b*), of a free-arm sewing machine incorporating an embodiment of the invention. The drive mechanism includes the same rotating wheel 24 connected to the link 22 at the pin 25. Otherwise, the driving mechanism is different from that of FIG. 1(*b*). In place of the conventional pinion 20 of FIG. 1(*b*) that is directly coaxially connected to the oscillating hook 5, the pinion 30 of the illustrated embodiment of the invention does not have a conventional circular cross-section with a cylindrical surface having uniformly spaced teeth engaging uniformly spaced teeth on a conventional rack. Rather, as shown in FIG. 4, the radius of the pinion 30 is variable with respect to circumferential position. Likewise, a rack 31 does not have a straight edge with uniformly spaced and sized gear teeth. For a first part of the circumference of the pinion 30, within an arc 32, where the radius is relatively smaller (and non-uniform) than in a second part of the circumference outside the arc 32, the width of the rack 31 is increased proportionately to accommodate the variable radius of the pinion 30. Because of this width variation, coordinated with the variation in the radius of the pinion 30, the rack 31 generally follows a transverse path of constant elevation when driven by rotation of the wheel 24, between extreme left and right positions.

As in the conventional mechanism, the rack 31 is driven in approximately simple harmonic motion between the extreme right and left positions. However, the angular velocity at which the pinion is turned by the movement of the rack 31, i.e., the velocity of the oscillating hook 5 that is directly connected to the pinion 30, deviates substantially from simple harmonic motion because of the variable radius of the pinion 30. Where the radius of the pinion 30 is relatively smaller, the acceleration of the pinion and of the oscillating hook 5, is increased. To achieve the desired increased speed of the hook finger 9 at the time it engages the needle thread loop 8, i.e., at the position illustrated in FIG. 2(*b*), the reduced radius of the pinion is coordinated with the position of the hook finger 9 illustrated in FIG. 2(*b*).

As shown in FIG. 4, the radius of the pinion 30 is reduced over an arc 32 as compared with the remainder of the pinion 30. The arc 32 defines a first circumferential part of the pinion. When the rack 31 and the pinion 30 are in contact with any part of the pinion within the arc 32, the speed of the hook finger 9 is increased relative to the speed when teeth on the pinion 30 outside the arc 32 are in contact with the rack 31. For example, with the driving wheel 24 in the position illustrated in FIG. 4 and rotating clockwise, the rack 31 is positioned just after the point of maximum travel in the right hand direction of FIG. 4. That position corresponds to the time immediately before the engagement of the needle thread loop 8 and the hook finger 9. Thus, relative to the simple harmonic motion of the hook finger 9 produced in the prior art, the maximum rotational acceleration of the pinion 30 and the hook 5 are arranged to occur just after reversal of the direction of rotation of the hook 5, i.e., Just prior to the engagement of the needle thread loop 8 by the hook finger 9. As the rack 31 continues to move toward the left in the FIG. 4, the radius of the pinion 30 contacting the rack 31 increases. Thus, the rotational acceleration of the pinion 30 and of the oscillating hook 5 decreases toward the acceleration of the drive mechanism of FIG. 1(*b*). When the rack 31 moves sufficiently leftward in FIG. 4 so that the contact between the pinion 30 and the rack 31 is outside the arc 32, the radius of the pinion 30 becomes constant and the speed and acceleration of the pinion are similar to those produced by the drive mechanism of FIG. 1(*b*), consistent with the hook positions and motion reversal timings of FIGS. 2(*a*)–2(*d*).

In the mechanism of FIG. 4, the acceleration of the oscillating hook 5 is inversely proportional to the radius of the pinion 30 so that the acceleration of the oscillating hook 5 relative to simple harmonic motion may reach a maximum just after reversal of the rotational motion of the oscillating hook 5 and decrease toward that of the conventional structure as the point of contact between the pinion 30 and the rack 31 reaches an edge of the arc 32.

Figure 1A:
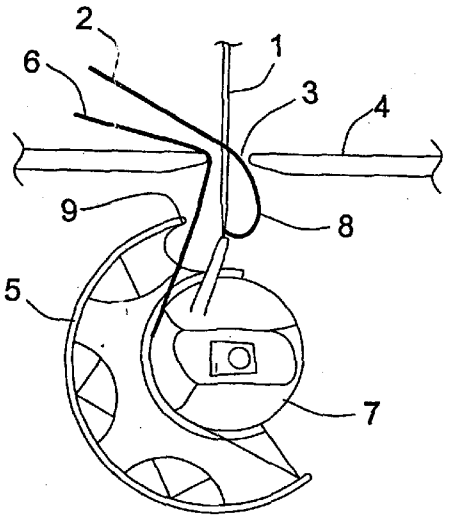
FIG. 1(a) PRIOR ART
FIG. 1(*a*) is a schematic front view of the conventional free-arm part of a sewing machine, partially broken away, showing an arrangement of an oscillating hook and bobbin.
Figure 1B:
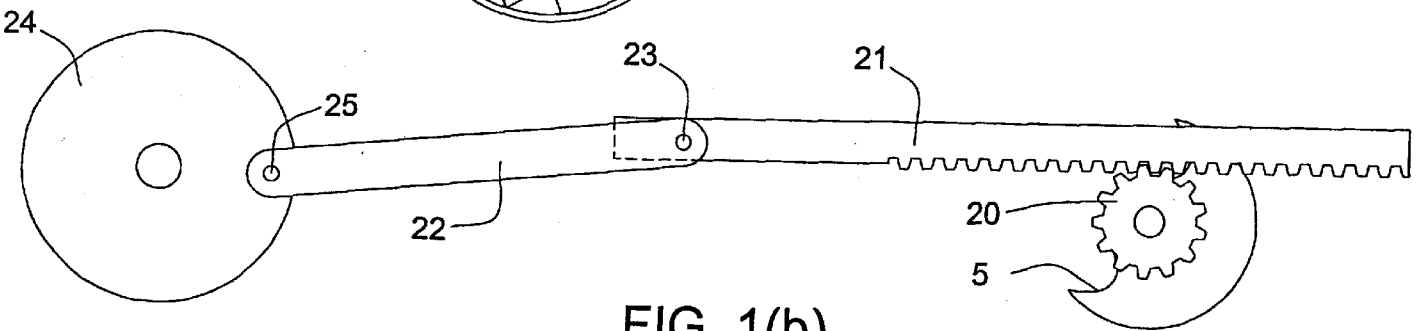
FIG. 1(b) PRIOR ART
Figure 2D:
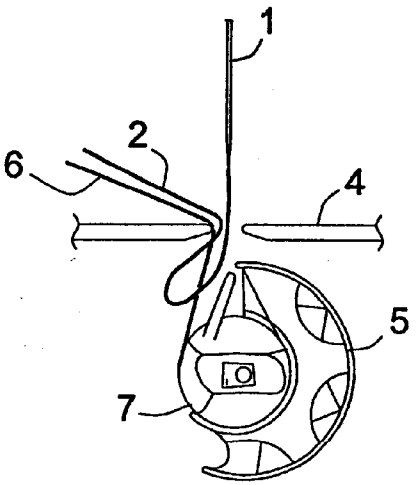
FIGS. 2(*a*)–2(*d*) show a sequence of positions of an oscillating hook in forming a stitch.
Figure 2C:
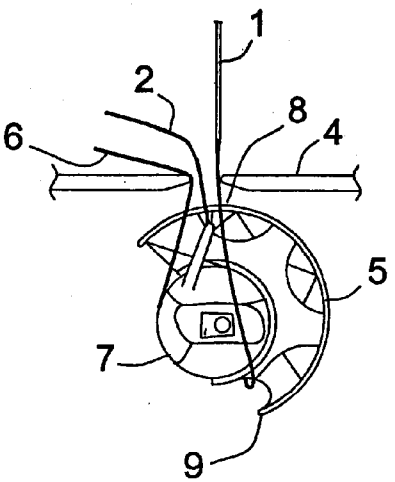
Figure 2B:
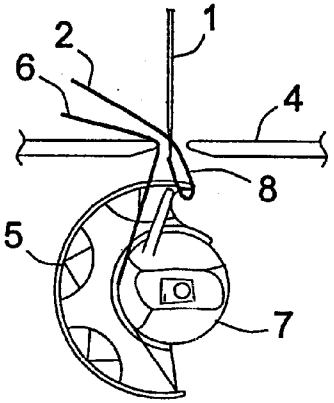
Figure 2A:
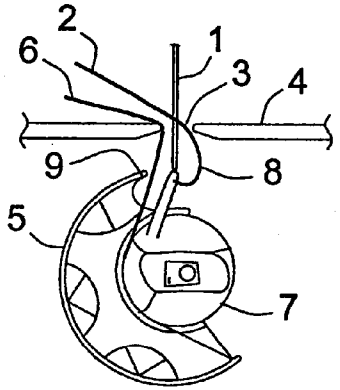
Figure 3C:
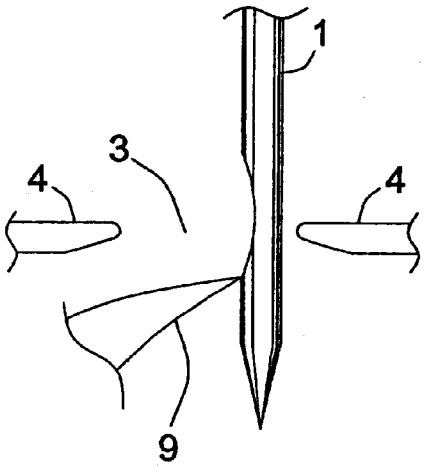
FIGS. 3(*a*)–3(*c*) show relative positions of an oscillating hook and a sewing machine needle during hooking of a needle thread loop for different transverse needle positions.
Figure 3B:
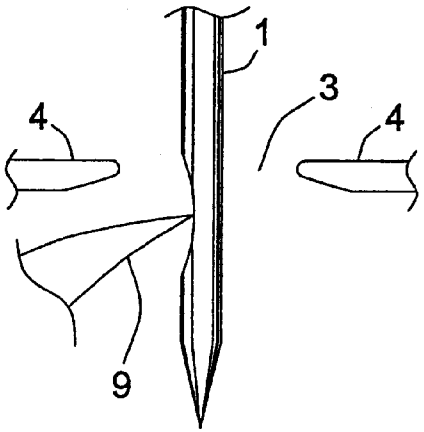
Figure 3A:
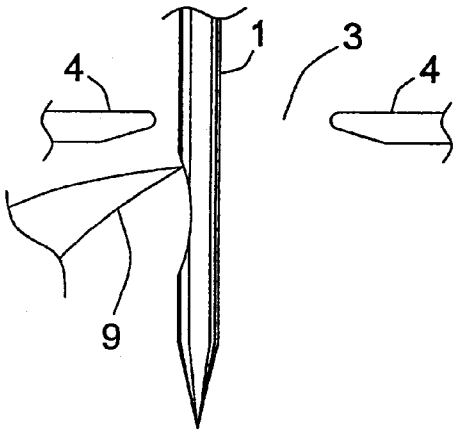

Because of the increased speed and acceleration of the hook finger 9 at the time of engagement of the needle thread loop 8, the transverse needle swing amplitude, as explained with respect to FIGS. 3(*a*)–3(*c*), where the hook finger 9 can reliably engage the needle thread loop 8, is, effectively, increased relative to the drive mechanism of FIG. 1 (*b*). Put another way, because of increased acceleration and speed of the hook, the needle thread loop is engaged reliably over the same range of positions relative to the needle shank, but with a wider transverse needle swing amplitude.

Comparing the relative dimensions of the eccentric pinion 30 of FIG. 4 and the symmetrical pinion 10 of FIG. 1 (*b*), if the minimum radius of the pinion 20 is approximately 0.56 that of the constant radius of the pinion 20, the increased velocity of the book finger 9 at the time of engagement with the needle thread loop 8 will be sufficient to increase transverse needle swing to an amplitude of 9 millimeters, i.e., 4.5 millimeters in each direction relative to the center position of the needle 1. Stated another way, the increase in rotational speed of the hook finger 9 at the time of engagement of the needle thread loop 8, over the speed of the conventional oscillating hook, needed to achieve an amplitude of 9 mm compared to the conventional 5 mm is eighty percent for this and the other described embodiments.

Numerous variations of the invention will become apparent to those of skill in the art. For example, the radius of the pinion 30 outside the arc 32 may be variable with circumferential position provided the average radius outside the arc 32 is always larger than the average radius within the arc 32. With regard to the embodiment of FIG. 4 and the similar embodiments described below, various retention structures can be applied to the racks to ensure that they are not disengaged from the corresponding pinions. For instance, the rack 31 may be urged into engagement with the pinion 30 by a spring structure. In addition, it may be appropriate to provide a counterbalancing mass within the pinion 30 so that its center of mass is aligned with the rotational axis of the pinion. Ensuring mass balance of the pinion may be important in avoiding undue vibration and noise. Further, although the pinion 30 and oscillating hook 5 are shown as coaxial, their axes need not be aligned, providing the pinion and oscillating hook are coupled by a transmission.

The embodiment of the invention described with respect to FIG. 4 provides for driving of the oscillating hook in a manner that deviates from simple harmonic motion with a relatively simple construction. By employing alternate mechanical structures, other deviations from simple harmonic motion by the oscillating hook can be achieved. Examples of such embodiments are described below with respect to FIGS. 5–9.

Figure 5:
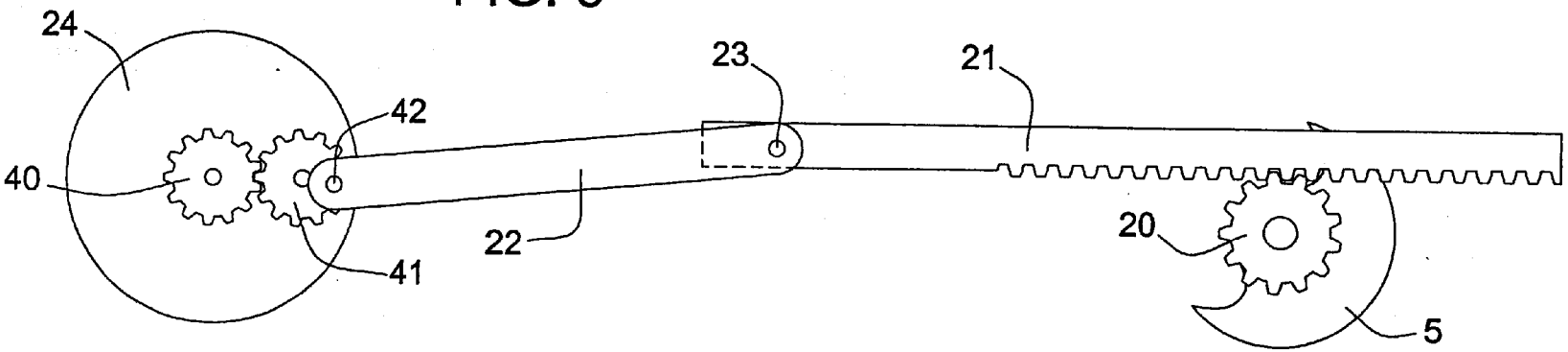
FIG. 5 is a schematic diagram illustrating another embodiment of the invention.

FIG. 5 schematically shows a mechanism including the oscillating hook 5, the pinion 20, the rack 21, and the link 22. The link 22 is joined to the rack pivotally by a pin 23, as in the conventional structure shown in FIG. 1(*b*). However, the structure driving the link 22 and the rack 21 is substantially different from the conventional structure. The wheel 24 is still rotated by an electric motor (not shown) and synchronized with the needle movement, but the wheel 24 includes at its center a gear 40 coaxially mounted with the wheel 24 but not rotating with the wheel 24. Rather, that sun gear 40 is stationary. A planetary gear 41 is mounted on the wheel 24 and freely turns about a central pin that is fixedly mounted eccentrically on the wheel 24. The teeth of the sun gear 40 and the planetary gear 41 are engaged. As the wheel 24 rotates, the planetary gear 41 also rotates both with the wheel 24 and because of its engagement with the sun gear 40. The link 22 is pivotally connected at a pin 42 to the planetary gear at a location spaced from the axis of the planetary gear 41. Thus, when the wheel 24 turns, the lever 22 is driven in a complex fashion. Rather than being driven in nearly simple harmonic motion as in the conventional structure shown in FIG. 1 (*b*), that simple harmonic motion is modulated by the additional driving motion provided by the planetary gear 41.

The modulation imparted by the sun and planetary gears 40 and 41 depends upon the relationship between the numbers of teeth on those gears. If the gears contain the same number of teeth, properly spaced and sized so that the teeth smoothly engage through the motion the wheel 24 and the planetary gear 41, the planetary gear 41 will rotate once relative to the rotating platform of the wheel 24 and twice relative to a fixed platform for each revolution of the wheel 24. This relationship means that a second harmonic motion component is imposed on the first harmonic motion of link 22 when it is driven by the conventional mechanism in FIG. 1 (*b*). The amplitude of this modulating second harmonic motion component is controlled by the distance between the pin 42 and the center of the planetary gear 41. In the illustrated embodiment, the rotational velocity of the oscillating hook 5 with respect to the simple harmonic motion of the conventional structure of FIG. 1 (*b*) is maximized just before the hook finger 9 engages the needle loop thread 8. This result is achieved by appropriately phasing, i.e., adjusting the position of the oscillating hook 5, through the pinion 20, on the rack 21, relative to the positions of the sun and planetary gears 40 and 41.

The structure shown in FIG. 5 can be altered to provide harmonics higher than the second harmonic of the basic simple harmonic motion of the link 22 of the conventional mechanism. Higher order harmonics of the basic simple harmonic motion can provide a higher rotational speed for the oscillating hook near the zero velocity points of the motion of the hook and a slower speed intermediate of those two extreme zero velocity locations. This further speed versus position change in the movement of the oscillating hook may permit still higher amplitude transverse needle swings. The higher harmonic motion may be achieved by changing the relative numbers of teeth on the planetary and sun gears 41 and 40. More complex arrangements, for example, with cascaded rotating gears rather than a single planetary gear 41 of FIG. 5 may be employed to achieve still more complex modulation of the basic harmonic motion of link 22 and rack 21.

Figure 6:
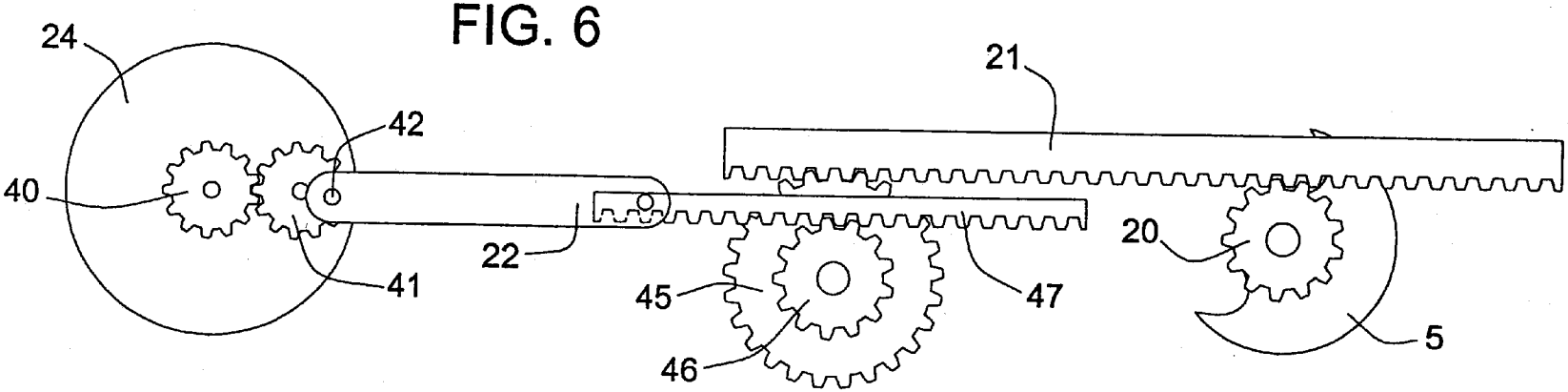
FIG. 6 is a schematic diagram illustrating still another embodiment of the invention.

FIG. 6 is a schematic view of an alternative to the embodiment of FIG. 5. The embodiment of FIG. 6 may be particularly useful in meeting the space requirements of a free-arm sewing machine, taking less vertical space than the embodiment of FIG. 5. The embodiment of FIG. 6 differs from the embodiment of FIG. 5 in that the rack 21 engaging the pinion 20 also engages a second pinion 45. That second pinion 45 is coaxially mounted with a smaller pinion 46 that engages a second rack 47. The second rack 47 is pivotally connected by a pin 48 to link 22 that is pivotally connected at the pin 42 to the planetary gear 41. The operation of the embodiment of FIG. 6 is the same as the operation of the embodiment of FIG. 5 except that the coaxial pinions 45 and 46 increase the velocity of movement of the rack 21 with respect to the movement of the link 22, assuming that the pinions 45 and 46 include teeth of similar pitch. In this embodiment, since the racks 21 and 47 move almost completely horizontally and the vertical movement of link 22 is limited, the height within the free-arm of a conventional consumer sewing machine can easily accommodate the movement of the mechanical parts.

Figure 7:
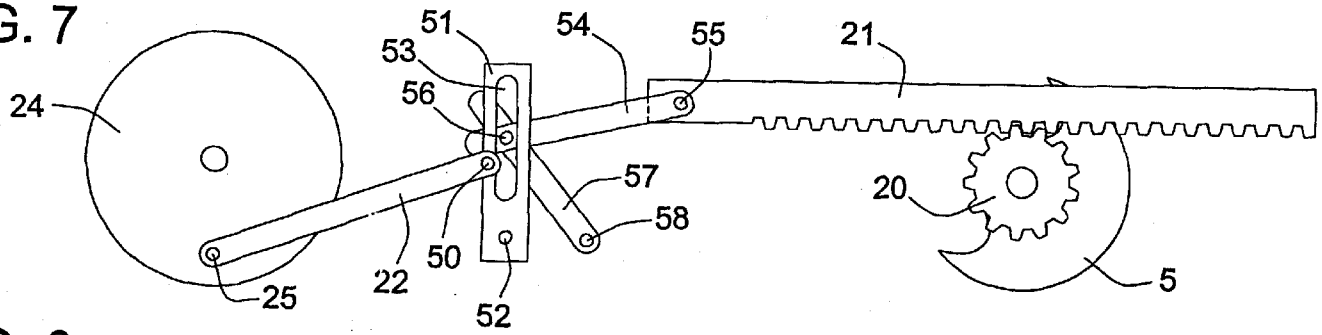
FIG. 7 is a schematic diagram illustrating a further embodiment of the invention.
Figure 8:
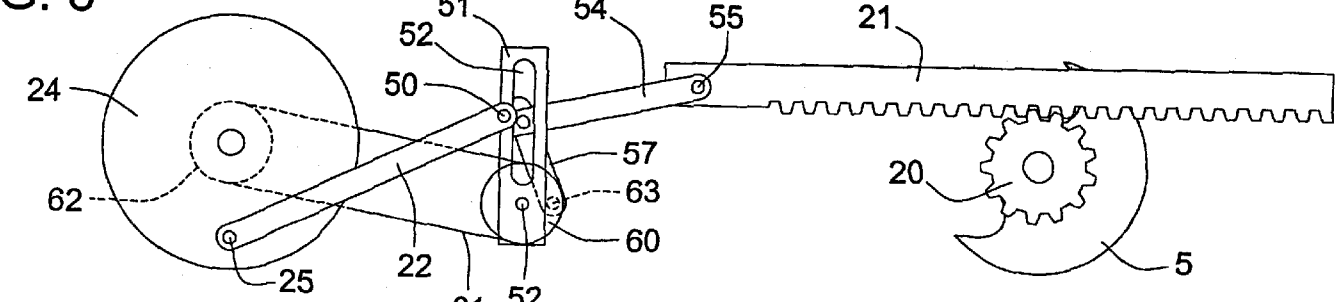
FIG. 8 is a schematic diagram illustrating yet another embodiment of the invention.
Figure 9:
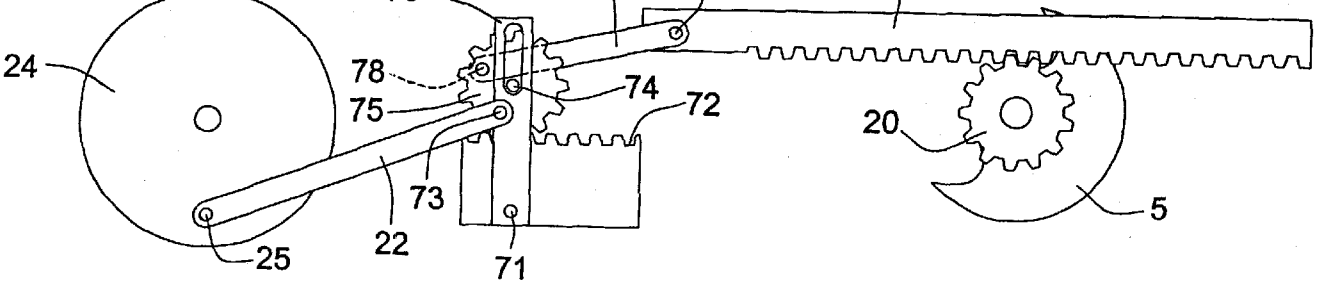
FIG. 9 is a schematic diagram illustrating one more mechanical embodiment of the invention.

The embodiments of FIGS. 7–9 illustrate similar complex embodiments of mechanisms for driving the oscillating hook 5 so that the movement of the oscillating hook substantially departs from simple harmonic motion and has sufficiently increased velocity at the time of engaging the needle thread loop to permit wider swing of the needle. The embodiments of FIGS. 7–9 all commonly include the oscillating hook 5 coaxially mounted with and coupled to the pinion 20. The pinion 20 engages the rack 21. Likewise, each of the embodiments includes the rotating wheel 24 that drives the rack 21 through intermediate coupling elements. The coupling elements all include a link 22 that is pivotally connected through a pin 25 to the wheel 24 near the periphery of the wheel. However, the coupling arrangements in each of the embodiments of FIG. 7–9 differ substantially from each other.

In the embodiment of FIG. 7, the end of the link 22 that is not pivotally coupled to the wheel 24 is pivotally connected at a pin 50 to a slotted lever 51. The lever 51 is pivotally connected at a pin 52 to a fixed element. As the wheel 24 rotates, the slotted lever 51 oscillates in simple harmonic motion. The slotted lever 51 includes a slot 53 shown oriented vertically in FIG. 7. A link 54 is pivotally connected at one of its ends by a pin 55 to the rack 21. The opposite end of the link 54 includes a projecting pin 56 that has captured within the slot 53 the lever 51. The pin 56 can slide within the slot 53, the lever 51 pivots in response to rotation of the wheel 24. A stabilizing link 57 is pivotally connected at a pin 58. The stabilizing link 57 is connected to the link 54 and the pin 56.

In the embodiments of FIGS. 7–9, a second harmonic motion with a different frequency is superimposed on a fundamental harmonic motion of the lever 51 that is produced in the conventional structure of FIG. 1(*b*). In the embodiment of FIG. 7, as the slotted lever 51 oscillates, the pin 56 slides in the slot 53. The pin 56 rises toward one end of the slot 53, the top end in the illustration of FIG. 7, just before the engagement of the needle thread loop 8 by the hook finger 9. At that position, the oscillating hook is moving with the fastest speed of its cyclic movement. After engagement of the needle thread loop, the slotted lever 51 reverses the direction of motion, moving toward the left in FIG. 7 and the pin 56 slides downward, in that view, within the slot 53. The pin 56 reaches approximately its lowest point within the slot 53 at the time of release of the needle thread loop 8 from the oscillating hook finger 9. Thus, the needle loop thread release occurs essentially at the lowest speed of the oscillating hook 5 whereas the needle thread loop is engaged at the highest speed of the oscillating hook 5. As in the other embodiments, the phasing achieving this result requires coordinating the position of the oscillating hook relative to the extreme left/right positions of the rack 21. Although not illustrated in FIG. 7, the dual pinion and dual rack arrangement of FIG. 6 can be incorporated into the embodiment shown in FIG. 7 if necessary to step-up the speed of the pinion 20 driving the oscillating hook 5.

FIG. 8 illustrates the structure related to the embodiment of FIG. 7. Similar elements are given similar numbers. In addition to the elements similarly numbered and already described with respect to FIG. 7, the embodiment of FIG. 8 includes a second rotating wheel 60 coaxially mounted on the pin 52 about which the lever 51 also oscillates. The second wheel 60 is connected to the wheel 24 by an endless belt 61 engaging a pulley 62, shown in phantom, on the rear side of the wheel 24. The stabilizing lever 57 is pivotally connected at one end by a pin 63 to and near the periphery of the second wheel 60.

The operation of the embodiment of FIG. 8 is essentially identical to that of the embodiment of FIG. 7. The operation of the stabilizing link 57 is synchronized with the rotation of the wheel 24 through the endless belt 61 engaging the second wheel 60 and the pulley 62. As with the embodiment of FIG. 7, the dual pinion structure of FIG. 6 can be used to modify the embodiment of FIG. 8.

FIG. 9 shows yet another embodiment of a driving mechanism including a pivoting lever. In FIG. 9, a pivoting lever 70 is pivoted about a pin 71 fastened to stationary second rack 72. The lever 70 is pivoted by the link 22 that is coupled to the driving wheel 24. The link 22 is pivotally connected at one end by the pin 25 to the driving wheel 24 and pivotally connected at the other end by a pin 73 to the lever 70. The lever 70 also includes a pin 74 that provides a rotational axis of a second pinion 75. The second pinion 75 engages the rack 72. A second link 76 is pivotally connected to one end of the rack 21 at a pin 77. The opposite end of the second link 76 is pivotally connected at a pin 78 near the periphery of and to the second pinion 75.

When the wheel 24 rotates, the link 22 causes the lever 70 to pivot about the pin 71. This pivotal movement to the right and left in FIG. 9 causes rotation of the second pinion 75 because of the engagement of second pinion 75 with the second rack 72. The rotation of the second pinion 75 supplies a harmonic motion to the first rack 21. However, because of the complex driving mechanism, second harmonic motion, as in the other described mechanisms with respect to FIGS. 7 and 8, for example, modulates the harmonic motion. As a result of this compound harmonic motion, the speed of the hook finger 9 in engaging the needle thread loop 8 is increased over the conventional driving mechanism so that the amplitude of the transverse needle swing can be increased. As with the embodiments of FIGS. 7 and 8, the embodiment of FIG. 9 can be modified by adding the dual rack and pinion mechanism of FIG. 6.

The invention has been described with respect to certain embodiments. However, additions and modifications of the invention as described within the spirit and scope of the disclosure are encompassed by the following claims.

I claim:

1. In a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook, the drive mechanism including:

a rotating driving wheel;

a rack coupled to the driving wheel and oscillating transversely between two extreme positions in response to rotation of the driving wheel; and a pinion engaging the rack, the pinion being coupled to and driving the oscillating hook, wherein the pinion has a radius that varies over a first part of a circumference of the pinion and has an average radius over a second part of the circumference of the pinion that is larger than an average of the radius over the first part of the circumference, and the rack has a width that varies with position to accommodate the radius of the pinion that varies, whereby, in response to a constant rotation speed of the driving wheel, the hook is oscillated at a rotational velocity that varies with rotational position of the hook so that swing amplitude of the needle transverse to the linear direction may be increased.

2. The drive mechanism of claim 1 including a link pivotally coupled at a first end to the driving wheel and pivotally coupled at a second end to the rack.

3. The driving mechanism of claim 1 wherein the pinion is coupled to the oscillating hook so that the first part of the circumference of the pinion engages the rack immediately after the rack moves from at least one of the two extreme positions.

4. The driving mechanism of claim 1 wherein the rotational velocity of the oscillating hook immediately after the rack moves from at least one of the two extreme positions is larger than the rotational velocity of the oscillating hook when the pinion is in simple harmonic motion.

5. In a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook, the drive mechanism including:

a rotating driving wheel;

a rack coupled to the driving wheel and driven transversely in simple harmonic motion between two extreme positions in response to rotation of the driving wheel; and a pinion engaging the rack, the pinion being coupled to and driving the oscillating hook and having a non-uniform radius, and the rack having a varying width where the rack engages the pinion to accommodate the non-uniform radius of the pinion, whereby, in response to a constant rotation speed of the driving wheel, the hook is oscillated at a velocity that varies with rotational position of the hook so that swing of the needle transverse to the linear direction may be increased.

6. The drive mechanism of claim 5 including a link pivotally coupled at a first end to the driving wheel and pivotally connected at a second end to the rack.

7. The driving mechanism of claim 5 wherein the pinion is coupled to the oscillating hook so that a part of the pinion having a relatively small radius compared to other parts of the pinion engages the rack immediately after the rack moves from at least one of the two extreme positions.

8. The driving mechanism of claim 5 wherein the rotational velocity of the oscillating hook immediately after the rack moves from at least one of the two extreme positions is larger than the rotational velocity of the oscillating hook when the pinion is in simple harmonic motion.

9. In a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook, the drive mechanism including:

a rotating driving wheel having a coaxially mounted stationary first gear and a rotating second gear eccentrically mounted on the rotating driving wheel and engaging the first gear;

a rack coupled to the driving wheel and oscillating transversely between two extreme positions in response to rotation of the driving wheel;

a link coupling the rack to the driving wheel, pivotally connected at a first end to the second gear and pivotally connected at a second end to the rack for driving the rack in response to rotation of the driving wheel; and a pinion engaging the rack, the pinion being coupled to and driving the oscillating hook, whereby, in response to a constant rotation speed of the driving wheel, the hook is oscillated at a rotational velocity that varies with rotational position of the hook so that swing amplitude of the needle transverse to the linear direction may be increased.

10. The driving mechanism of claim 9 wherein the rotational velocity of the oscillating hook immediately after the rack moves from at least one of the two extreme positions is larger than the rotational velocity of the oscillating hook when the pinion is in simple harmonic motion.

11. In a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook, the drive mechanism including:

a rotating driving wheel having a coaxially mounted stationary first gear and a rotating second gear eccentrically mounted on the rotating driving wheel and engaging the first gear;

a first rack coupled to the driving wheel and oscillating transversely between two extreme positions in response to rotation of the driving wheel;

a first pinion engaging the first rack and including a coaxial second pinion, the first and second pinions differing in diameter;

a second rack engaging the second pinion; and a third pinion engaging the second rack and driving the oscillating hook, whereby, in response to a constant rotation speed of the driving wheel, the hook is oscillated at a velocity that varies with rotational position of the hook so that swing of the needle transverse to the linear direction may be increased.

12. The drive mechanism of claim 11 including a link pivotally coupled at a first end to the second gear and pivotally coupled at a second end to the first rack.

13. The driving mechanism of claim 11 wherein the rotational velocity of the oscillating hook immediately after the first rack moves from at least one of the two extreme positions is larger than the rotational velocity of the oscillating hook when the third pinion is in simple harmonic motion.

14. In a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook, the drive mechanism including:

a rotating driving wheel;

a rack coupled to the driving wheel and oscillating transversely between two extreme positions in response to rotation of the driving wheel;

a slotted lever including a longitudinal slot, the slotted lever being pivotally mounted on a pivot at a first end of the slotted lever remote from the slot;

a first link pivotally connected at a first end to the driving wheel and pivotally connected at a second end to the slotted lever;

a second link pivotally connected at one end to the rack and including a pin at a second end, the pin being slidably disposed in the longitudinal slot of the slotted lever for sliding relative to the slotted lever in response to rotation of the driving wheel and pivoting of the slotted lever for driving the rack; and a pinion engaging the rack, the pinion being coupled to and driving the oscillating hook, whereby, in response to a constant rotation speed of the driving wheel, the hook is oscillated at a rotational velocity that varies with rotational position of the hook so that swing amplitude of the needle transverse to the linear direction may be increased.

15. The drive mechanism of claim 14 including a pivoting stabilizing lever pivotally mounted at a first end and fixedly attached to the second link, opposite the pin, at a second end.

16. The drive mechanism of claim 14 wherein the driving wheel includes a pulley and further including a rotating wheel coaxially mounted with the pivot of the slotted lever, an endless belt trained around the pulley and the rotating wheel for turning of the rotating wheel in response to rotation of the driving wheel, and a third link pivotally connected at a first end to the rotating wheel and fixedly connected to the second link, opposite the pin, at a second end.

17. The driving mechanism of claim 14 wherein the rotational velocity of the oscillating hook immediately after the rack moves from at least one of the two extreme positions is larger than the rotational velocity of the oscillating hook when the pinion is in simple harmonic motion.

18. In a sewing machine including a needle oscillating along a linear direction and threaded with a needle thread forming a loop, a bobbin threaded with a bobbin thread, and an oscillating hook having a hook finger engaging and moving the loop so that the loop surrounds and is pulled tight against the bobbin thread for each stitch, a drive mechanism for driving the oscillating hook, the drive mechanism including:

a rotating driving wheel;

a pivoting lever pivoted at a first end and coupled to the driving wheel;

a first rack;

a first pinion engaging the first rack and rotationally mounted on a pin on the pivoting lever;

a second rack oscillating transversely between two extreme positions in response to rotation of the driving wheel;

a link pivotally connected at one end to the first pinion and pivotally connected at a second end to the second rack; and a second pinion engaging the second rack, the second pinion being coupled to and driving the oscillating hook whereby, in response to a constant rotation speed of the driving wheel, the hook is oscillated at a velocity that varies with rotational position of the hook so that swing of the needle transverse to the linear direction may be increased.

19. The drive mechanism of claim 18 including a second link pivotally coupled at a first end to the driving wheel and pivotally connected at a second end to the pivoting lever.

20. The driving mechanism of claim 18 wherein the rotational velocity of the oscillating hook immediately after the second rack moves from at least one of the two extreme positions is larger than the rotational velocity of the oscillating hook when the second pinion is in simple harmonic motion.

* * * * *